US007249433B2

(12) United States Patent
Wilson

(10) Patent No.: US 7,249,433 B2
(45) Date of Patent: Jul. 31, 2007

(54) MUZZLELOADER TOOL

(76) Inventor: Alford L. Wilson, 12369 Hickory Grove Rd., Richmond, MO (US) 64085

( * ) Notice: Subject to any disclaimer, the term of this patent is extended or adjusted under 35 U.S.C. 154(b) by 276 days.

(21) Appl. No.: 11/182,105

(22) Filed: Jul. 14, 2005

(65) Prior Publication Data

US 2006/0162219 A1 Jul. 27, 2006

Related U.S. Application Data

(60) Provisional application No. 60/699,197, filed on Jul. 14, 2005, provisional application No. 60/588,020, filed on Jul. 14, 2004.

(51) Int. Cl.
*F41C 7/00* (2006.01)

(52) U.S. Cl. ..... 42/51; 42/108

(58) Field of Classification Search ..... 42/51, 42/108; 81/124.7, 20; 7/114
See application file for complete search history.

(56) References Cited

U.S. PATENT DOCUMENTS 6,145,235 A * 11/2000 Emerson et al. ..... 42/90

* cited by examiner

*Primary Examiner*—Michael J. Carone
*Assistant Examiner*—Gabriel J. Klein
(74) *Attorney, Agent, or Firm*—Sonnenschein Nath & Rosenthal LLP

(57) ABSTRACT

A tool for use with a black powder gun (muzzleloader) is provided. The tool combines multiple tools useful to a black powder gun user in the field into a single unit. One embodiment of the tool includes a capper, a decapper (also called a deprimer), a bullet starter, a ramrod handle, and a ramrod push aid. Another embodiment of the invention includes a bullet starter, a ramrod handle, a ramrod push aid, and a socket wrench.

5 Claims, 2 Drawing Sheets

MUZZLELOADER TOOL

This application claims priority pursuant to 35 U.S.C. 119(e) to co-pending U.S. Provisional Patent Application Ser. No. 60/588,020, filed Jul. 14, 2004, and to co-pending U.S. Provisional Patent Application Ser. No. 60/699,197, filed Jul. 14, 2005, the entire disclosures of which are incorporated herein by reference.

FIELD OF THE INVENTION

The present invention relates generally to a tool for use with a muzzleloader firearm. More particularly, one embodiment of the present invention is concerned with a multi-purpose tool for use with a muzzleloader that includes a capper, a decapper (also called a deprimer), a bullet starter, a ramrod handle, and a ramrod push aid. Another embodiment of the present invention is concerned with a multi-purpose tool for use with a muzzleloader that includes a bullet starter, a ramrod handle, a ramrod push aid, and a socket wrench.

BACKGROUND OF THE INVENTION

Muzzle-loading firearms (also commonly referred to as black-powder firearms and/or simply as muzzleloaders), including long guns (e.g., guns described as muskets, carbines, shotguns and rifles) and handguns (e.g., pistols), are loaded by packing powder and shot in the barrel of the gun, and then inserting a primer cap into a primer nipple to enable firing of the gun. The use of muzzle-loaders has become quite popular for both target shooting as well as hunting. Many people enjoy the old-fashioned experience associated with muzzle-loading, in addition to the added skills utilized when firing a muzzleloader.

The steps involved in loading a black-powder firearm that ultimately add to the appeal of the sport, require the use of a wide assortment of tools by the shooter to properly operate the firearm and to address complications that arise while shooting. In many instances in which the shooter is moving with the firearm, such as during hunting, it is desirable to minimize the amount of tools being carried so as to lighten the shooter's load as well as to avoid losing a tool. If a tool is left behind or lost, the shooter's excursion may be cut short when an unexpected complication arises with the firearm. Therefore, it would be beneficial to provide a single tool that can be used for a variety of different situations encountered by a black-powder shooter.

SUMMARY OF THE INVENTION

An object of the instant invention is to provide a tool that can be used for a variety of different situations encountered by a black-powder shooter. Another object of the instant invention is to provide a tool that can be used for a variety of different situations encountered by a black-powder shooter that is compact.

The objects of the instant invention are accomplished through the use of a single piece tool including a central core, two handle-portions protruding from the central core, a threaded shaft protruding from the central core for engagement with a ramrod, and a recess within the central core for aiding the user in pushing the end of a ramrod.

The two handle-portions protrude from opposing ends of the central core to form a t-handle. A generally cylindrical first handle-portion includes a concave recess at the end opposite of the central core. The concave recess generally conforms to the shape of a bullet, and the outer diameter of the first handle-portion is slightly smaller than the bore of the firearm so as to allow the first handle-portion to function as a bullet starter. In one embodiment of the instant invention, a second handle-portion includes a generally flat surface which terminates in a forked end that functions as a deprimer to aid the shooter in removing primer caps from the firearm. The flat surface and/or a hole inset within the flat surface of the second handle-portion functions as a caper for aiding the shooter in placing a primer cap in the nipple of the firearm. In another embodiment of the instant invention, the second handle-portion includes a socket tool, which in a preferred embodiment is pivotally connected to the central core. The socket tool replaces the primer/deprimer for use with newer black powder guns that do not require the use of a primer/deprimer tool. The socket is used to screw out the bridge plug, or to otherwise make in-field repairs/adjustments to the gun. The first handle-portion operates as a handle for the shooter when using the primer and deprimer (or socket) of the second handle-portion. The second handle-portion operates as a handle for the shooter when using the bullet starter of the first handle-portion. In one embodiment, the outer surfaces of the first and second handle portions are knurled to aid the user in gripping the tool during use. In another embodiment, the outer surfaces of the central core is knurled to aid the user in gripping the tool during use.

A threaded shaft extends from the central core in a direction generally perpendicular to the handle portions. In a preferred embodiment the threaded shaft is located within a cavity of the central core. The cavity has a diameter greater than the outer diameter of a ram rod that is adapted to be threaded to the threaded shaft. In a preferred embodiment, the threaded shaft is retained within the cavity by a set screw that is threaded into a hole drilled into the central core generally perpendicular to the axis of the threaded shaft and the axis of the cavity in which the shaft is positioned. In operation, a ram rod is threaded onto the threaded shaft and can then be manipulated using the t-handle (i.e. the first and second handle-portions) of the instant invention for leverage.

A generally concave recess is located in the surface of the central core directly opposing the threaded shaft. The diameter of the recess is larger than the diameter of a ram rod that is intended to be used in connection with the tool of the instant invention. The end of the ram rod is positioned within the recess and the t-handle (i.e. the first and second handle-portions) of the instant invention is held by the shooter as a downward force is applied to the ram rod. The recess allows the shooter to easily push the ram rod into the barrel, such as to insert a bullet or a patch, without imparting undue stress on the shooter's hand. The instant invention disperses the stress resulting from pushing against the relatively narrow diameter of the ram rod across the entire surface of the t-shaped handle. In addition, the recess allows the shooter to quickly utilize the t-shaped handle for pushing a ram rod, without requiring that the ram rod be threaded to the handle.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

Figure 1A:
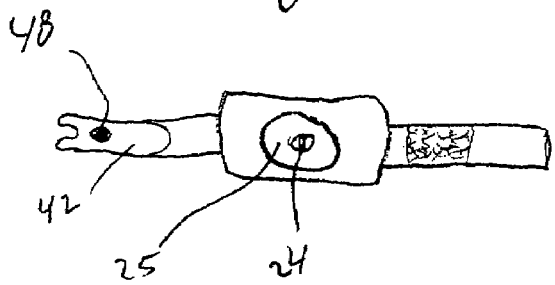
FIG. 1*a* is a top plan view of the tool shown in FIG. 1.
Figure 1B:
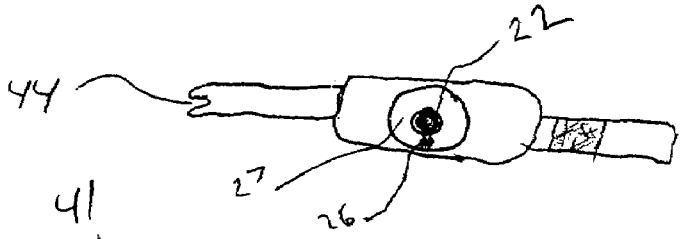
FIG. 1*b* is a bottom plan view of the tool shown in FIG. 1.
Figure 1C:
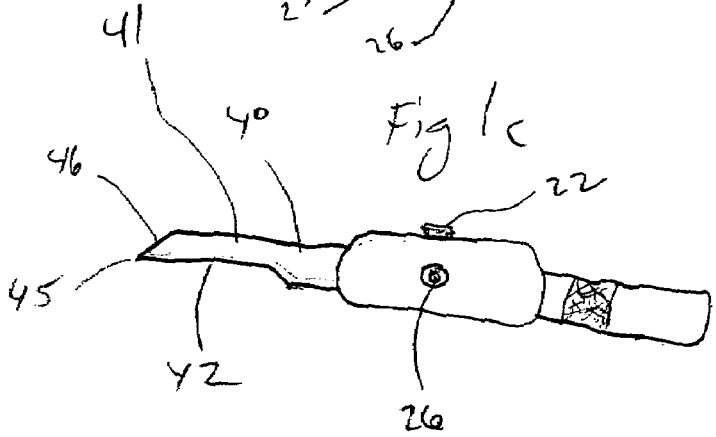
FIG. 1*c* is a side elevation view of the tool shown in FIG. 1.
Figure 1:
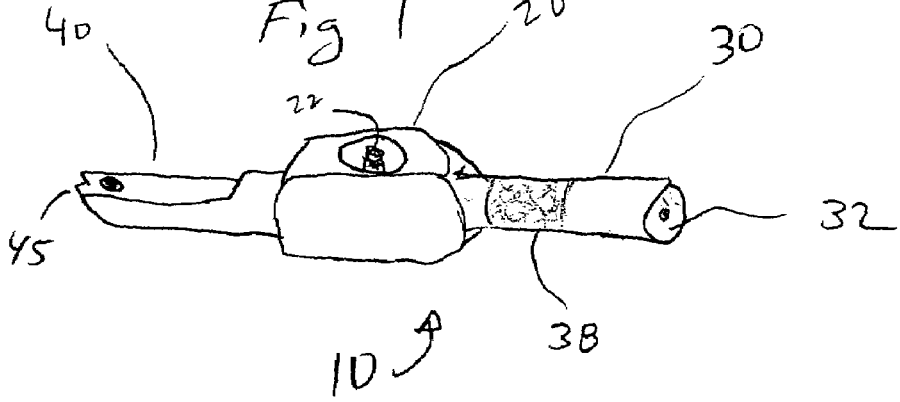
FIG. 1 is a perspective view from the bottom and side of a tool of a first embodiment of the instant invention.

As required, a detailed embodiment of the present inventions is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1, and 1*a*–1*c*, a first embodiment of a tool, 10, of the instant invention is shown. Tool 10 includes central core 20, first handle portion 30 extending from a first end of core 20, and second handle portion 40 extending from another end of core 20 generally opposite of the first end. First handle portion 30 includes recessed or concave end 32 generally conforming to the shape of a bullet for use with the gun for which tool 10 is to be used. In operation, first handle portion 30 of tool 10 is used as a bullet starter for the gun. First handle portion 30 also includes knurled surface 38 to aid in gripping of the tool by the user. Second handle portion 40 of the embodiment of tool 10 shown in FIGS. 1, and 1*a*–1*c* includes primer/deprimer tool 41.

In one embodiment of the instant invention, tool 10 is made primarily from a single piece of material, such that core 10 and handle portions 20 and 30 are all made from the same piece of material. Nevertheless, it will be appreciated that tool 10 of the instant invention can be constructed of two or more pieces of material that are connected together; as set forth below in alternative embodiments of the instant invention. For purposes of example of constructing tool 10 from a single piece of material reference is made to FIGS. 1 and 1*a*–1*c*. A preferred one-piece embodiment of tool 10 shown in FIGS. 1 and 1*a*–1*c*, tool 10 is made from a solid ¾ inch diameter metal shaft that is approximately 4 inches in length. A length of 1½ inches of each end of the shaft is milled down to 370000 to make first and second handle portions 20 and 30, respectively. Recess 32 is drilled into the end of first handle portion 30 for the bullet starter. Primer/deprimer tool 41 is constructed of flat surface 42 milled approximately 1 inch in length into second handle portion 40. Notch 44 is cut into end 45 of second handle portion 40 to make the deprimer (decapper) and hole 48 is drilled into flat surface 42 to make the and primer (capper). End 45 second handle portion 40 is cut to include sloped surface 46 to allow forked end 44 to be wedged under a cap for removal. If desired to have a generally squared shape, as opposed to the cylindrical shape of the base material, central core 20 can be milled to include a squared shape. A hole is drilled through central core 20 and tapped for placement of threads 22. Prior to insertion of threads 22 into core 20 recesses 25 and 27 are drilled into the top and bottom surfaces, respectively, of core 20 concentric with the hole drilled in core 20 for the threads. Recess 25 functions as the ramrod pusher tool, and recess 26 surrounds the ramrod when the ramrod is attached to threads 22. Threads 22 are screwed into the tapped hole in core 20 from the top of core 20 through recess 25 using screw head 24 of threads 22. Once threads are located in core 20 set screw 26 is inserted into a tapped hole that is drilled perpendicular to the hole for threads 22 to intersect the hole for threads 22. Set screw 26 is screwed tight against threads 22 to hold threads within core 20.

Alternatively, embodiments of the instant invention may be made from two or more separate pieces of material, with one piece (or more) being used for handle portions 30 and 40, and another piece being used for central core 20. These embodiment can be made in a similar manner to that of the one-piece embodiment described above, with the primary difference being the inclusion of a hole through the center of core 20 for receipt of the rod from which handle portions 30 and 40 are constructed. In addition a hole is drilled in core 20 perpendicular to and through the hole for handle portions 30 and 40, and a hole is drilled into the handle portions. Both holes (in the core and the handle) are tapped to for receipt of threaded shaft 22. Each side of the tapped hole of central core 20 is drilled out for recess 25 for pushing the ramrod on one side, and for cavity 27 for surrounding the ramrod when threaded to threaded shaft 22. Another hole is drilled in central core and handle portions perpendicular to the threaded shaft for insertion of a set screw to hold the threaded shaft in position. The threaded shaft holds the handle in position within the central core.

In another alternative embodiment, the bullet starter (handle portion 30) is made of a softer material (such as brass), while the remainder of the tool is made of a harder material (such as steel). Brass, which is a relatively soft metal, protects the gun barrel from damage when starting a bullet. In such case the core and bullet starter may be made from a single piece of brass in which a hole is drilled similar to that described with the two-piece construction above, but not all the way through the core. The steel primer/deprimer portion of the handle is then inserted into the hole in the core and held in place by the threaded shaft.

Photo 4 is views of several tools of the instant invention of differing shapes and sizes and made from different materials. Each tool is made in a manner similar to that described above in FIG. 1 and Photos 1–3. The tool on the far includes a brass core and brass bullet started as described in photo 3. The other tools include a one piece steel handle for the bullet starter and primer/deprimer made in the manner describe in FIG. 1, with the first tool on the left and third tool from the right having a steel central core and the rest of the tools having a brass central core. Most of the tools shown in Photo 4 (except the second from the left) include shafts for the bullet starter that have been trimmed down as described in FIG. 1. The second from the left tool includes a shaft that has not been trimmed.

Photo 5 is views of several other tools of the instant invention.

Figure 2A:
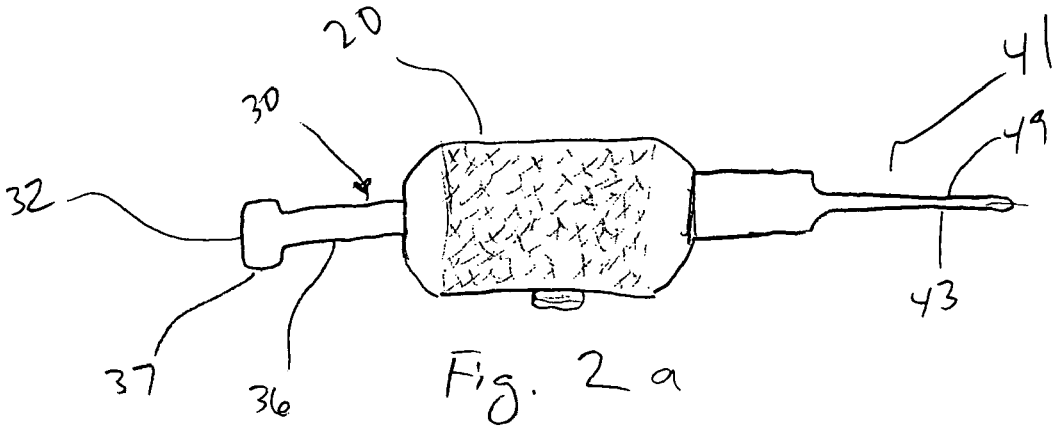
FIG. 2*a* is a side elevation view of a tool of another embodiment of the instant invention including an alternative primer/deprimer tool to that shown in FIG. 1.
Figure 2B:
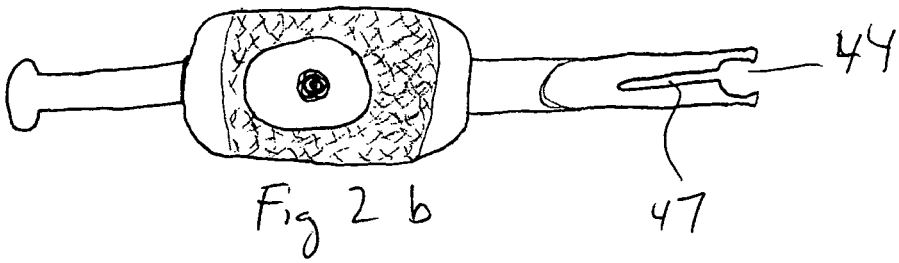
FIG. 2*b* is a bottom plan view of the tool shown in FIG. 2*a*.

FIGS. 2*a* and 2*b* show an alternative embodiment of tool 10 that includes an alternative design for primer/deprimer tool 41 described above with respect to FIGS. 1 and 1*a*–1*c*. As shown particularly in FIG. 2*a*, primer/deprimer tool 41 includes generally flat top and bottom surfaces 49 and 43, respectively. Elongated groove 47 extends from notch 44 to allow flexibility of primer/deprimer tool 41 such that notch 44 can fit tightly around a primer. FIGS. 2*a* and 2*b* also show a slightly different bullet starting tool in handle portion 30. As is shown, handle portion 30 includes trimmed down portion 36 which has a smaller diameter than starter portion 37. This allows recess 32 and starter portion 37 to conform around the bullet, while at the same time reducing potential damage to the cylinder bore that might be cause by the shaft of handle portion 30. Also shown in FIGS. 2*a* and 2*b*, core 20 includes a knurled surface for grasping by the user.

Figure 3A:
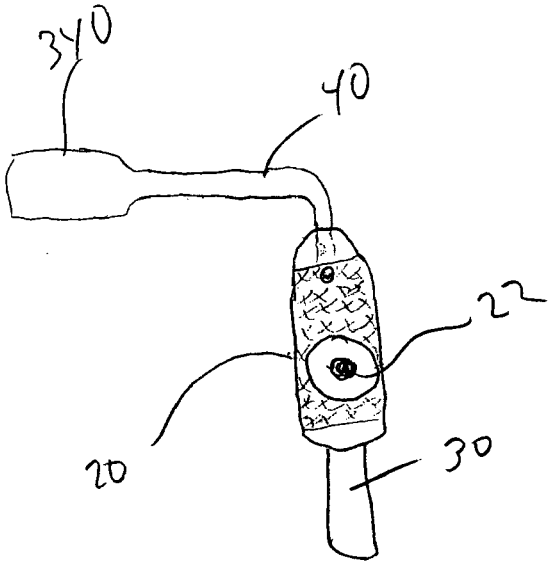
FIG. 3*a* is a bottom plan view of a tool of still another embodiment of the instant invention including a pivotal socket tool in an open position.
Figure 3B:
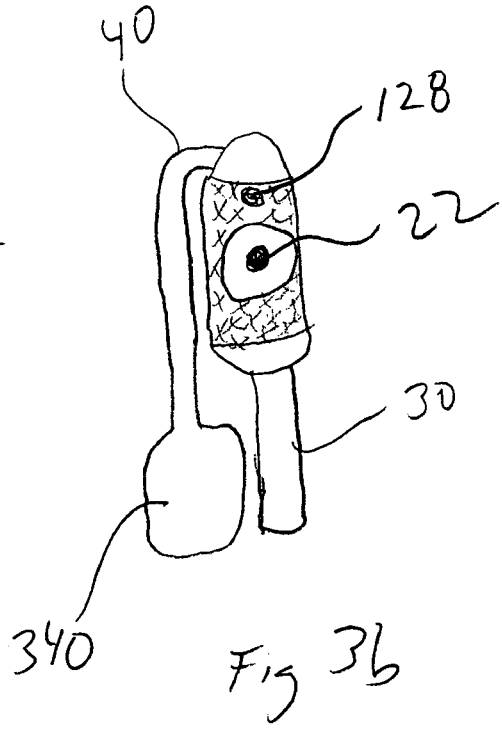
FIG. 3*b* is a bottom plan view of the tool shown in FIG. 3*a* showing the socket tool in a closed position.

FIGS. 3*a* and 3*b* show an alternative embodiment of tool 10 that includes socket tool 340 in place of primer/deprimer tool 41. As is shown in 3*a* and 3*b*, handle portion 40 is pivotally connected to core 20 by pivotal connection 128. Pivotal connection 128 may be a screw or other similar mechanical connection now known in the art or hereafter discovered. Pivotal connection 128 allows handle portion 40 to be folded inward towards core 20 for easier storage of tool 10, such as in the user's pocket. In use, handle portion 40 is folded outward as shown in FIG. 3*a* at an angle roughly perpendicular to handle portion 30, to be used as a wrench.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A multipurpose tool for use with a black powder gun comprising:

a central core;

a first handle portion protruding from one end of said core, said first handle portion comprising a first tool;

a second handle portion protruding from an other end of said core generally opposing said one end, said second handle portion comprising a second tool;

threads protruding from a bottom of said core, said bottom extending between said one end and said other end; and a recess in a top of said core, said top opposing said bottom.

2. The multipurpose tool as claimed in claim 1 wherein one of said first tool and said second tool comprises a bullet starter.

3. The multipurpose tool as claimed in claim 2 wherein the other of said first tool and said second tool comprises a primer and/or deprimer.

4. The multipurpose tool as claimed in claim 2 wherein the other of said first tool and said second tool comprises a socket wrench.

5. The multipurpose tool as claimed in claim 4 where said socket wrench is pivotally connected to said core.

* * * * *